US008002902B2

(12) United States Patent
Krowech

(10) Patent No.: US 8,002,902 B2
(45) Date of Patent: Aug. 23, 2011

(54) BOILER CLEANING APPARATUS AND METHOD

(76) Inventor: Robert J. Krowech, Eden Prairie, MN (US)

( * ) Notice: Subject to any disclaimer, the term of this patent is extended or adjusted under 35 U.S.C. 154(b) by 533 days.

(21) Appl. No.: 12/153,258

(22) Filed: May 15, 2008

(65) Prior Publication Data

US 2009/0282631 A1 Nov. 19, 2009

(51) Int. Cl.
*B08B 3/00* (2006.01)

(52) U.S. Cl. ..... 134/34; 134/39; 15/104.04; 254/104

(58) Field of Classification Search ..... None
See application file for complete search history.

(56) References Cited

U.S. PATENT DOCUMENTS 4,351,277 A 9/1982 Ryan et al.
4,572,284 A 2/1986 Katscher et al.
4,699,665 A * 10/1987 Scharton et al. ..... 134/1
4,840,145 A 6/1989 Vollhardt et al.
4,907,542 A 3/1990 Maeyama et al.
5,172,653 A 12/1992 Vadakin

FOREIGN PATENT DOCUMENTS

WO WO 02059538 A1 * 8/2002

* cited by examiner

*Primary Examiner* — Michael Kornakov
*Assistant Examiner* — Eric Golightly
(74) *Attorney, Agent, or Firm* — Richard C. Litman

(57) ABSTRACT

The boiler cleaning apparatus and method provides for cleaning the exterior surfaces of a heat exchanger. The apparatus and method include tools and steps, respectively, for temporarily spreading tubes with a wedge and holding open the tubes with a block to form and gain access to tube lanes. Once access to a lane is attained, a nozzle assembly having an outlet for blowing high velocity cleaning fluid is selected from a group of nozzle assemblies. The selected nozzle assembly will have an outlet for blowing fluid in a direction that effectively cleans the tubes adjacent the opened lane. After the tubes are cleaned the tool for holding the lane opened is removed and the process is repeated for another lane.

4 Claims, 19 Drawing Sheets

BOILER CLEANING APPARATUS AND METHOD

BACKGROUND OF THE INVENTION

1. Field of the Invention

The present invention generally relates to heating, ventilation, and air conditioning (HVAC) apparatus and to cleaning apparatus, and more specifically, to a boiler cleaning apparatus and method for cleaning the external surfaces of water-tube heat exchangers.

2. Description of the Related Art

The exterior surfaces of heat exchange tubes in a heat recovery steam generator or HRSG are exposed to the byproducts of combusting fuel gases. These byproducts include soot, slag and ash that adhere to the surfaces of the tubes, creating a layer that inhibits the rate of heat transfer between the fluid (water and/or steam) flowing inside the tubes and the combusting gases flowing on the exterior of the tubes. Decrease of heat transfer efficiency demands the burning of more fuel thus diminishing the efficiency of the HRSG and increasing the costs of operation. Furthermore, the layer of byproducts can function to cause tube wall degradation leading to premature tube failure. The art would certainly welcome an efficient method for thoroughly cleaning the exterior surfaces of the tubes and apparatus for accomplishing the same. Thus, a boiler cleaning method and apparatus solving the aforementioned problems is desired.

SUMMARY OF THE INVENTION

The boiler cleaning apparatus employs a unique apparatus to clean the exterior surfaces of a heat exchanger. The apparatus includes tools for temporarily spreading and holding open a tube bank to form and gain access to tube lanes. Once access to a lane is attained, a nozzle assembly having an outlet for blowing high velocity cleaning fluid is selected from a group of nozzle assemblies. The selected nozzle assembly will have an outlet for blowing fluid in a direction that effectively cleans the tubes adjacent the opened lane. After the tubes are cleaned the tool for holding the lane opened is removed and the process is repeated for another lane.

Accordingly, the invention presents a method and apparatus for cleaning boiler tubes that is effective and efficient. The invention provides for improved elements thereof in an arrangement for the purposes described that are inexpensive, dependable and fully effective in accomplishing their intended purposes.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
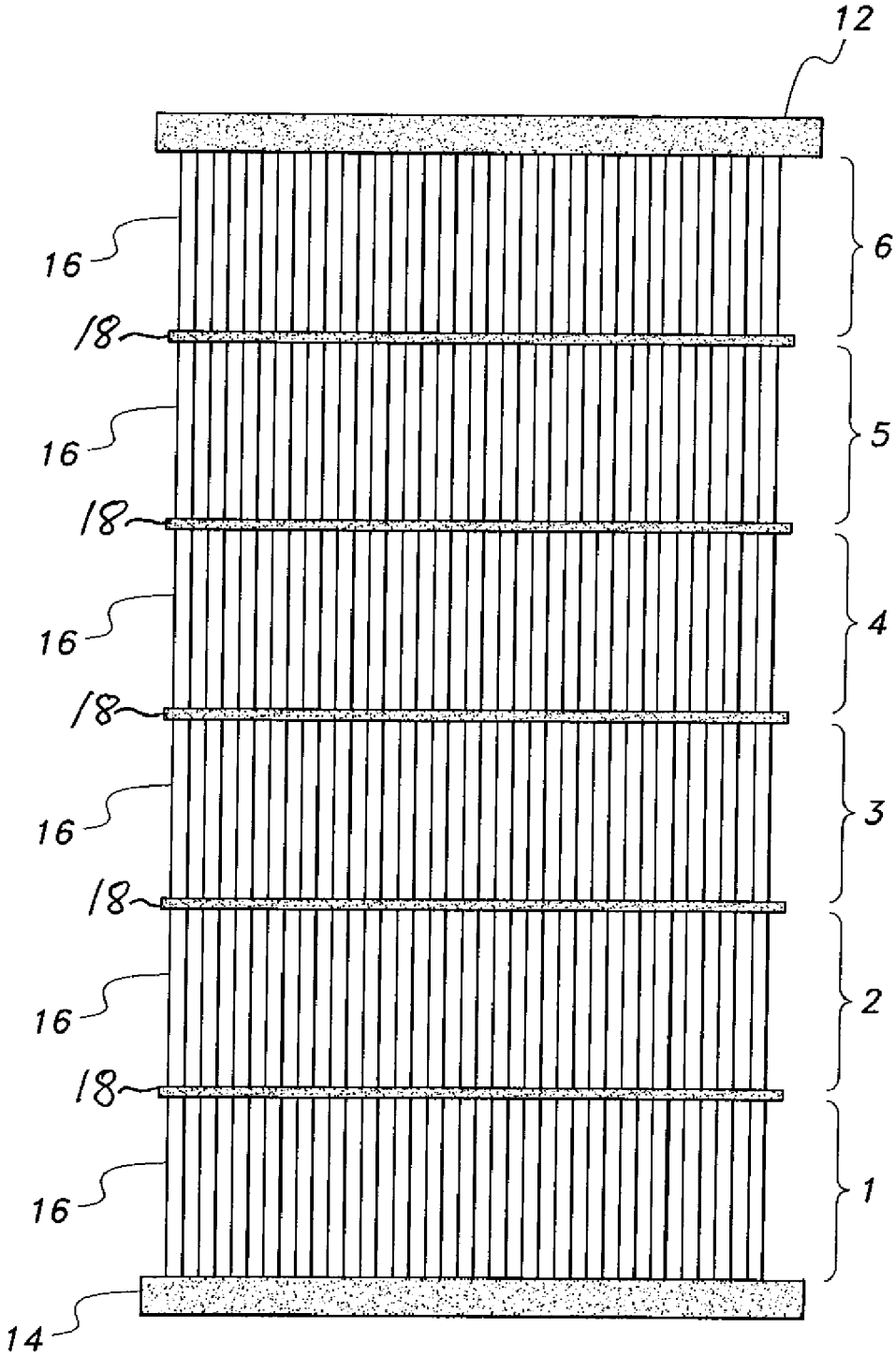
FIG. 1 PRIOR ART
FIG. 1 is a plan view of a typical tube regenerator panel to be cleaned by a boiler cleaning apparatus according to the present invention.

Attention is first directed to FIG. 1, which illustrates a typical panel in a triple wide panel configuration. The typical panel comprises respective upper and lower headers 12, 14, finned water tubes 16, and tube ties 18. Smaller areas or levels (1-6) between the tube ties are focused on during the cleaning process.

Figure 2:
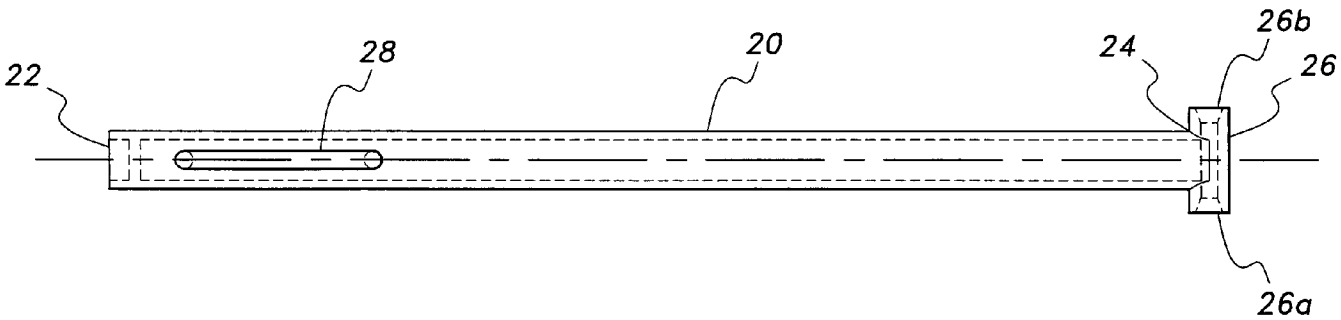
FIG. 2 is a top view of a side blow nozzle assembly of a boiler cleaning apparatus utilized to clean tubes of a water tube section according to the present invention.
Figure 3:
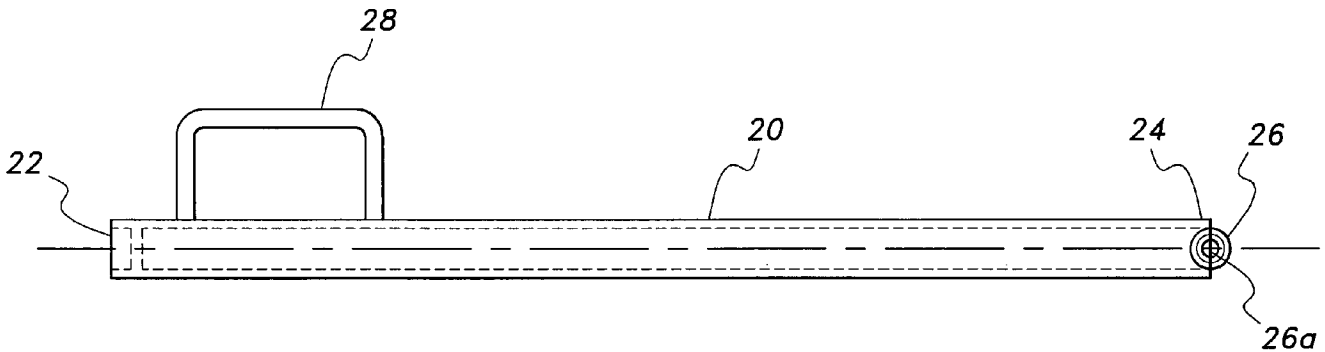
FIG. 3 is a side view of a side blow nozzle assembly of a boiler cleaning apparatus utilized to clean tubes of a water tube section according to the present invention.

A side blow nozzle assembly is shown in FIGS. 2 and 3. Side blow nozzle assembly comprises an elongate nozzle pipe 20 having a cleaning fluid entry end 22 and spraying end 24. A pipe 26 having diametrically opposed openings 26*a*, 26*b* defines the spraying end 24. Pipe 26 is perpendicular to nozzle pipe 20. A handle 28 is disposed on, the nozzle assembly to enhance manipulation thereof.

Figure 4:
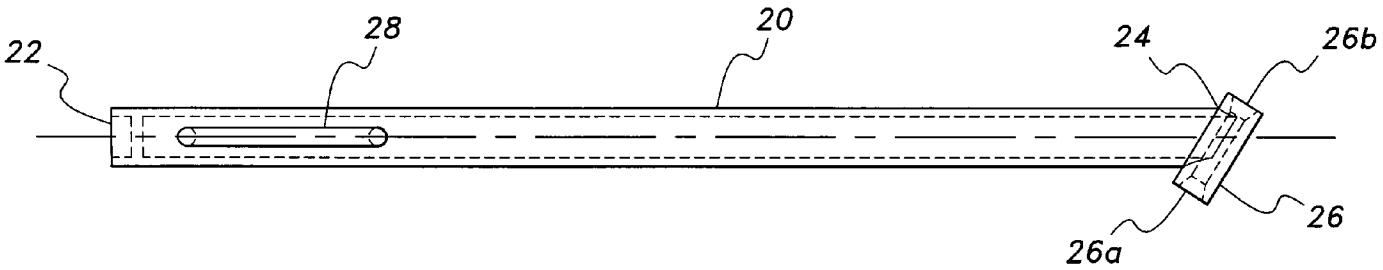
FIG. 4 is a top view of an angled side blow nozzle assembly of a boiler cleaning apparatus utilized to clean tubes of a water tube section according to the present invention.
Figure 5:
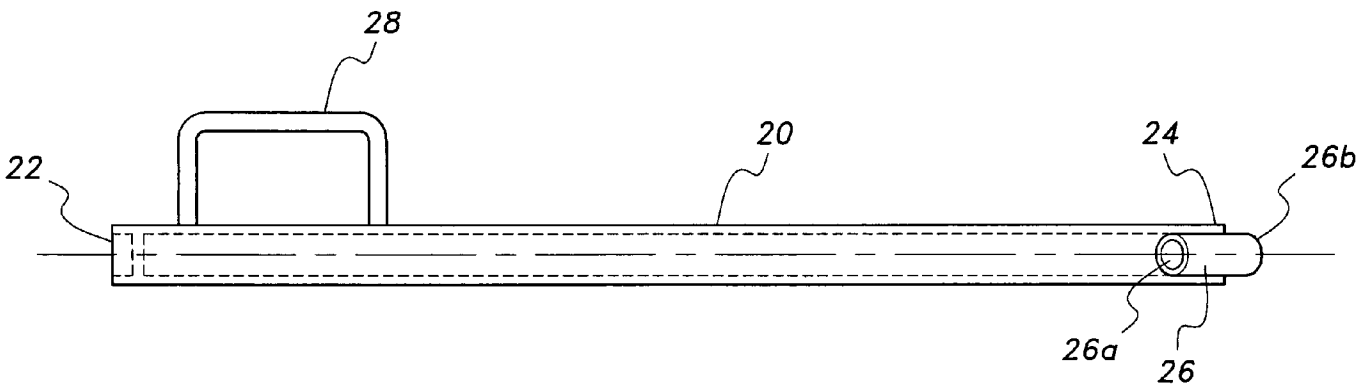
FIG. 5 is a side view of an angled side blow nozzle assembly of a boiler cleaning apparatus utilized to clean tubes of a water tube section according to the present invention.

Angled side blow nozzle assembly, illustrated in FIGS. 4 and 5, is similar to the nozzle assembly described immediately above except that the pipe 26 disposed at an acute angle of approximately sixty degrees with nozzle pipe 20.

Figure 6:
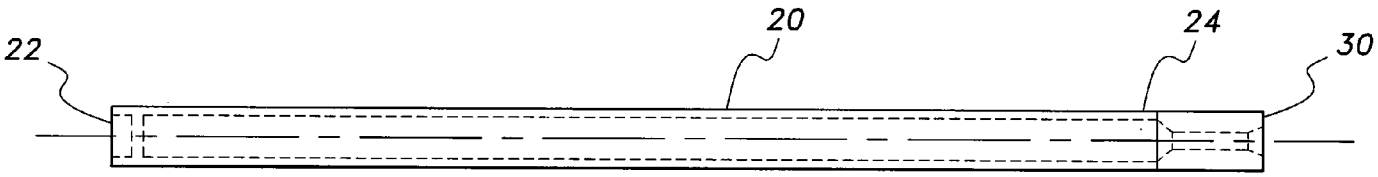
FIG. 6 is a top view of a short end blow nozzle assembly of a boiler cleaning apparatus utilized to clean tubes of a water tube section according to the present invention.
Figure 7:
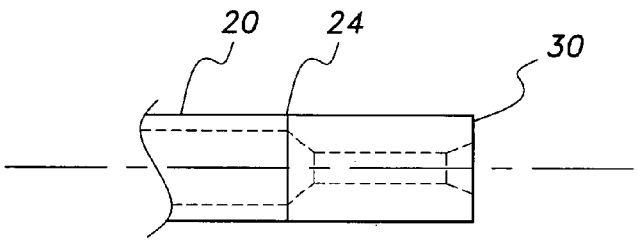
FIG. 7 is a partial view of a short end blow nozzle assembly of a boiler cleaning apparatus utilized to clean tubes of a water tube section according to the present invention.

The nozzle assembly of FIGS. 6 and 7 comprises an end blow spray outlet 30 having a direction that is coincident with the axis of nozzle pipe 20.

Figure 8:
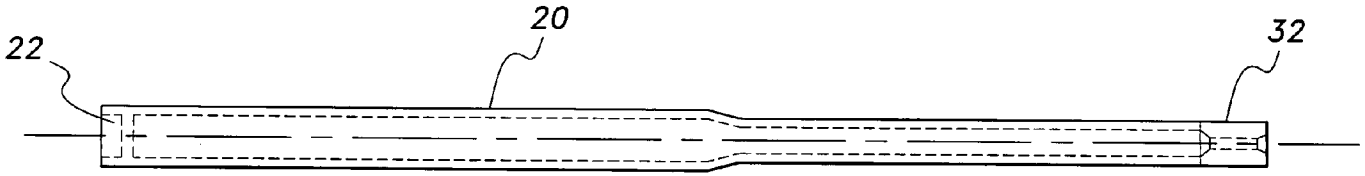
FIG. 8 is a side view of a flattened end blow nozzle assembly of a boiler cleaning apparatus utilized to clean tubes of a water tube section according to the present invention.
Figure 9:
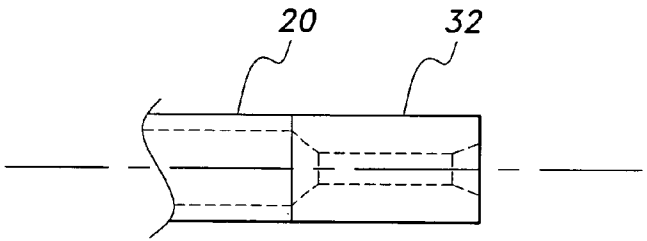
FIG. 9 is a partial view of a flattened end blow nozzle assembly of a boiler cleaning apparatus utilized to clean tubes of a water tube section according to the present invention.

The nozzle assembly of FIGS. 8 and 9 is similar to that of FIGS. 6 and 7 except that end blow spray outlet 32 is flattened. The length of the nozzle pipe and the dimensions of the fluid flow paths and spray outlets in all of the above nozzle assembly embodiments are determined according to the design and dimensions of the heat exchange panel to be cleaned.

Figure 10:
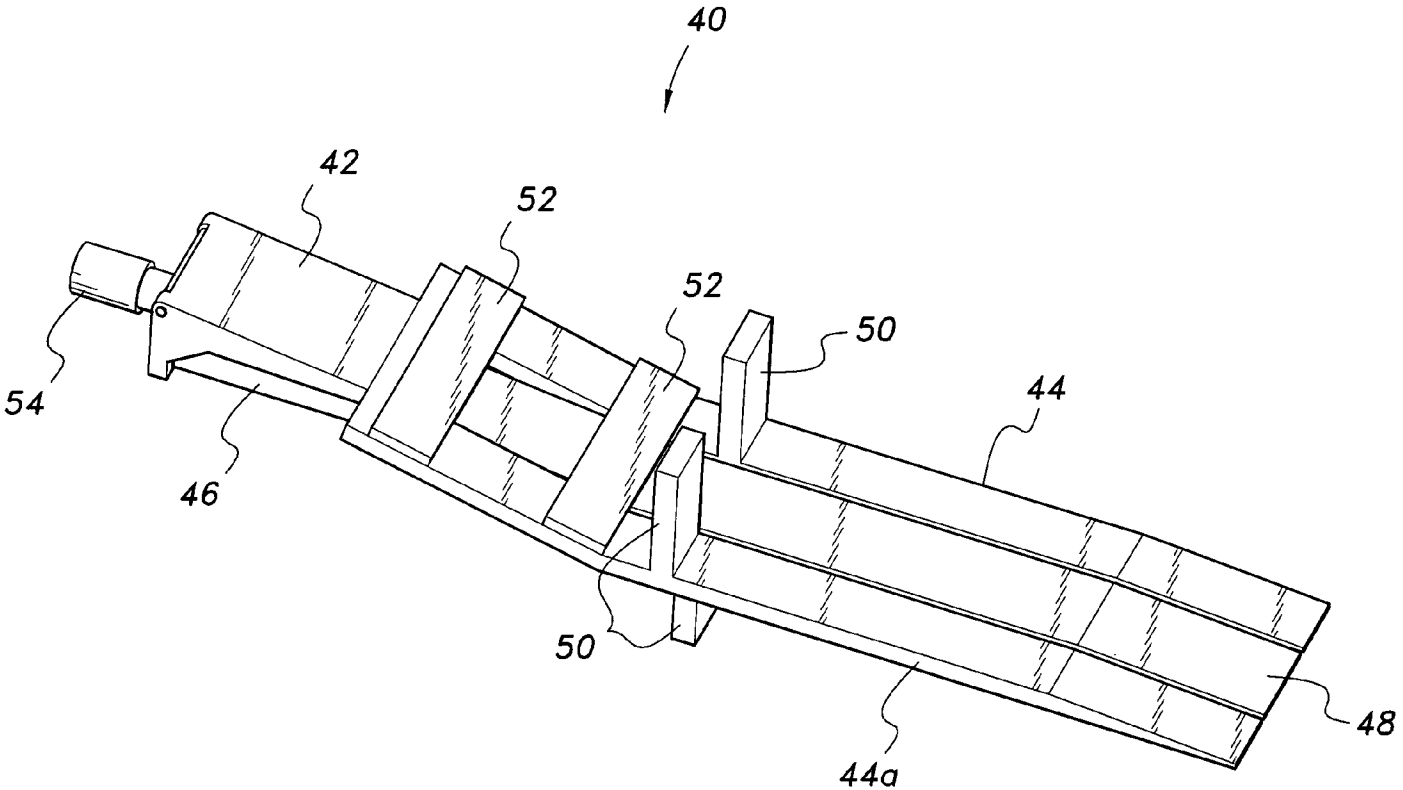
FIG. 10 is a perspective view of a hydraulic wedge device in a boiler cleaning apparatus, shown in a closed position according to the present invention.
Figure 11:
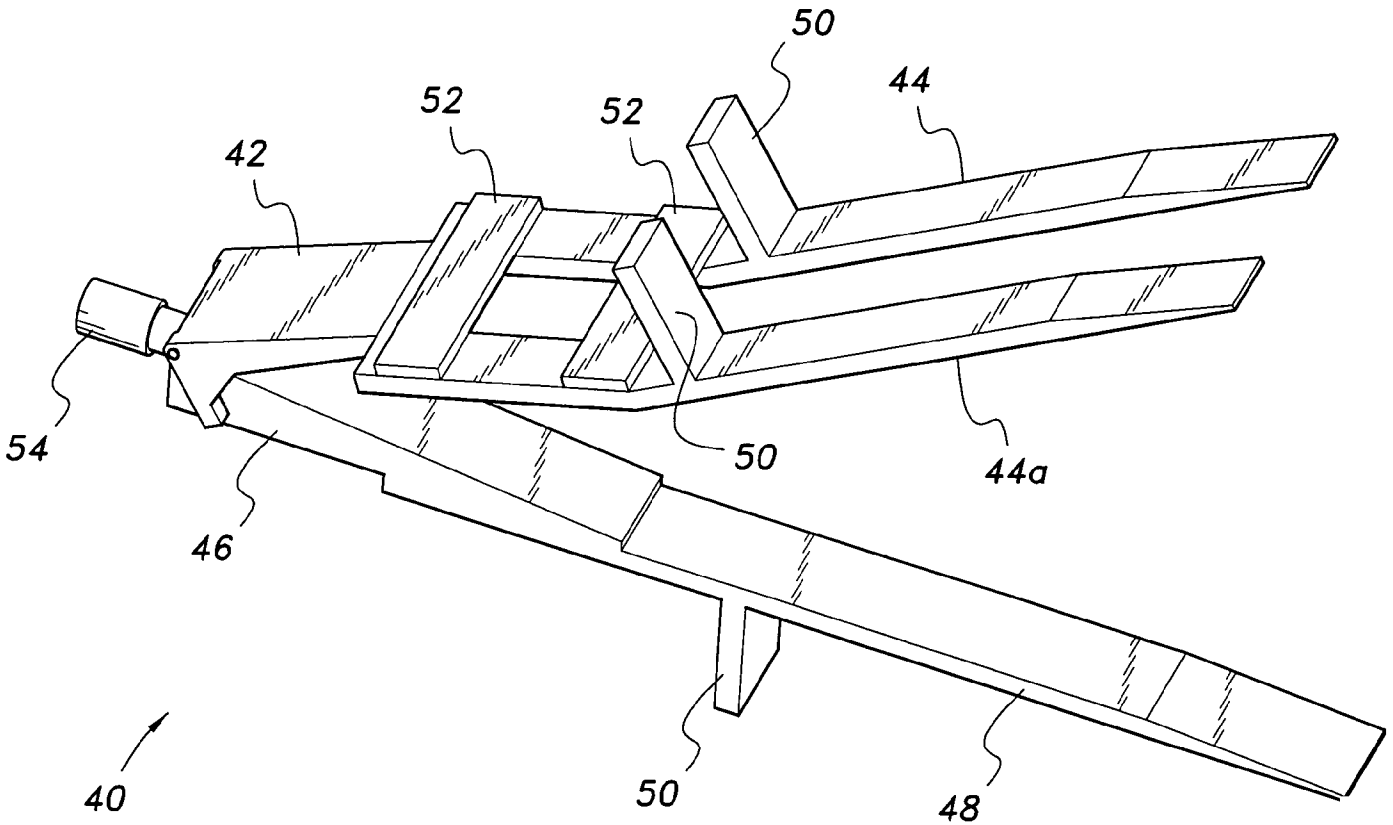
FIG. 11 is a perspective view of a hydraulic wedge device in a boiler cleaning apparatus, shown in an open position according to the present invention.
Figure 12:
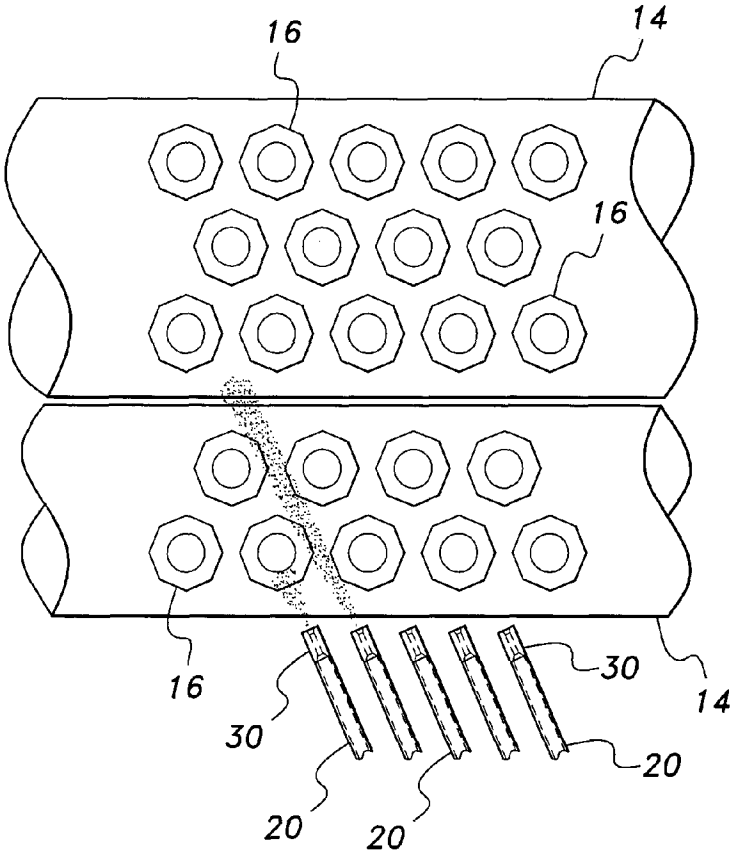
FIGS. 12, 13, 14, 15, 16, 17, 18, 19, 20, 21, 22, and 23 are perspective views showing steps utilized in the boiler cleaning method to clean tubes of a water tube section according to the present invention.

FIGS. 10 and 11 illustrate a unique tool utilized to spread the tubes of the panel to gain access to the inner tubes for cleaning. The tool is a hydraulically operated wedge and is generally indicated at 40. Wedge 40 comprises a top plate 42 having a pair of spaced tines 44, 44*a* connected thereto and extending therefrom. Top plate 42 is pivotally attached to a bottom plate 46. A single tine 48 is attached to and extends from bottom plate 46. When wedge 40 is closed (FIG. 10), tines 44, 44*a* and 48 lie in the same horizontal plane and tine 48 occupies the space between tines 44 and 44*a*. A respective stop block 50 is disposed on the upper surface of each tine 44, 44*a* and on the under surface of tine 48. A pair of support plates 52 is welded to the upper surfaces of tines 44, 44*a* for reinforcement purposes. A conventional, manually operated hydraulic pump 54 is connected to plates 42, 46 and functions to provide hydraulic fluid to open and close wedge 40. Wedges are fabricated at various lengths for purposes as will be described below.

Figure 13:
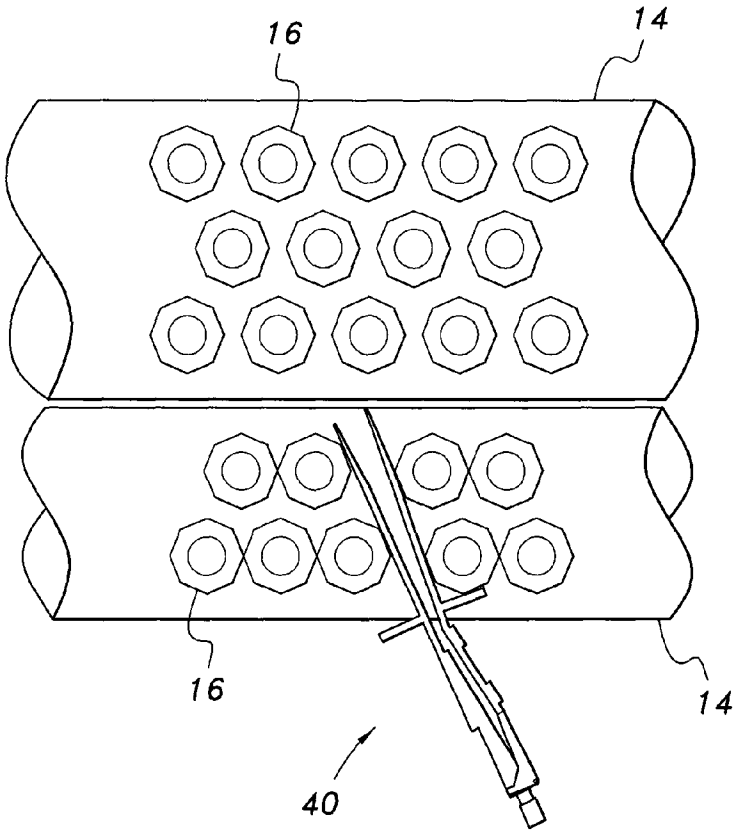
Figure 14:
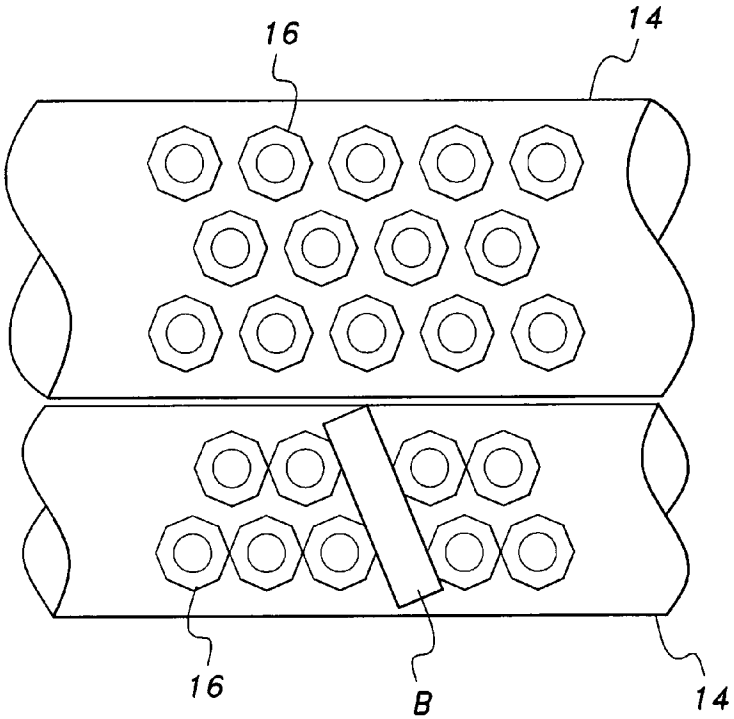
Figure 15:
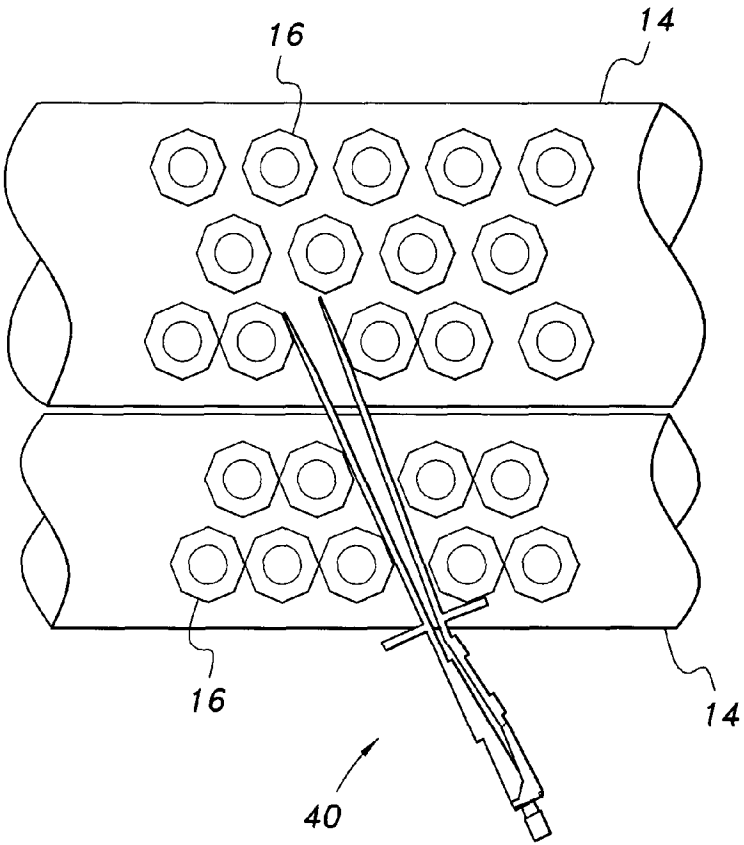
Figure 16:
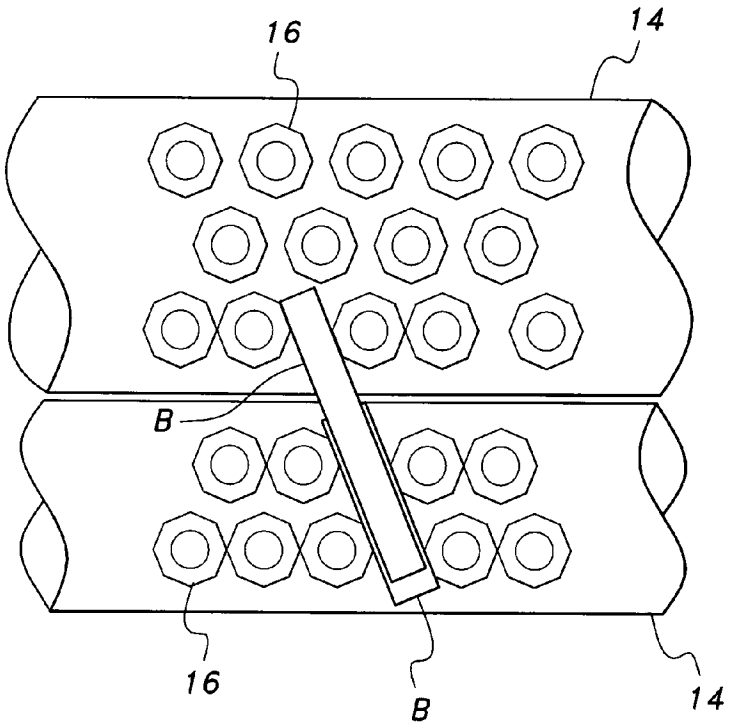
Figure 17:
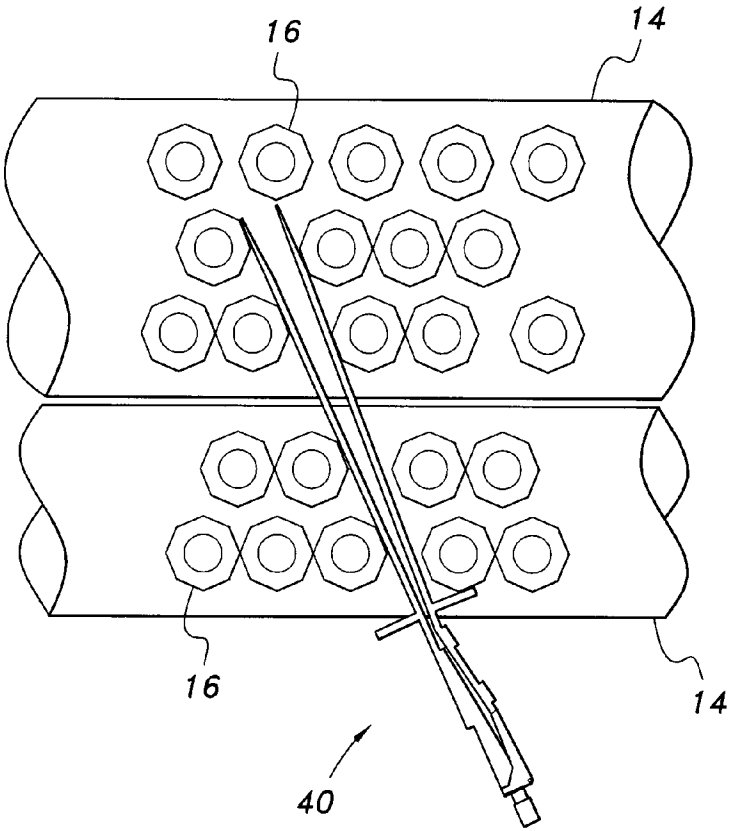
Figure 18:
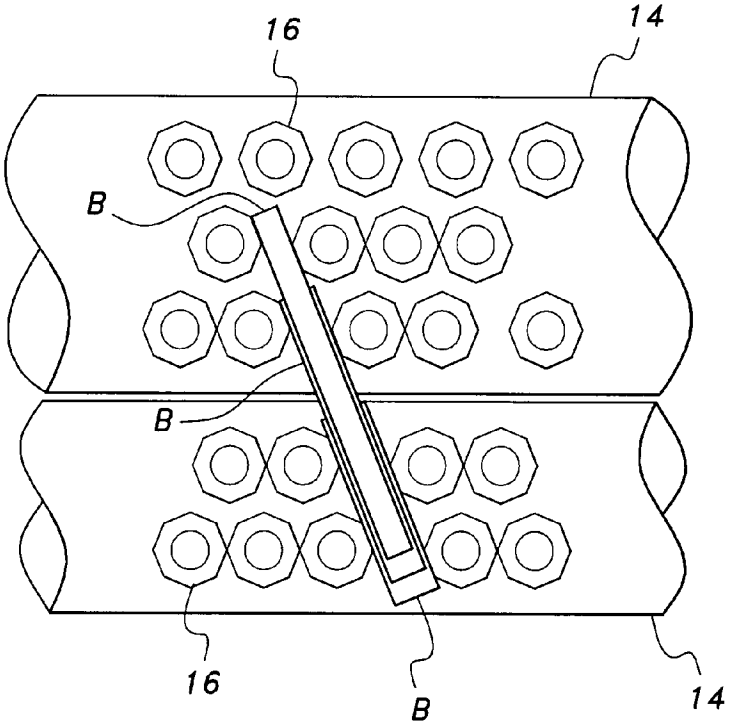
Figure 19:
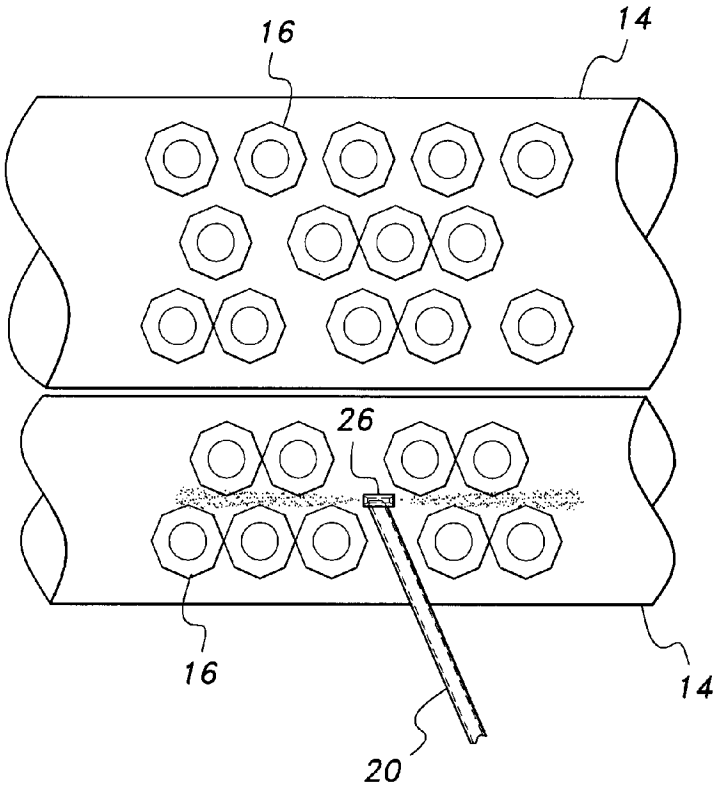
Figure 20:
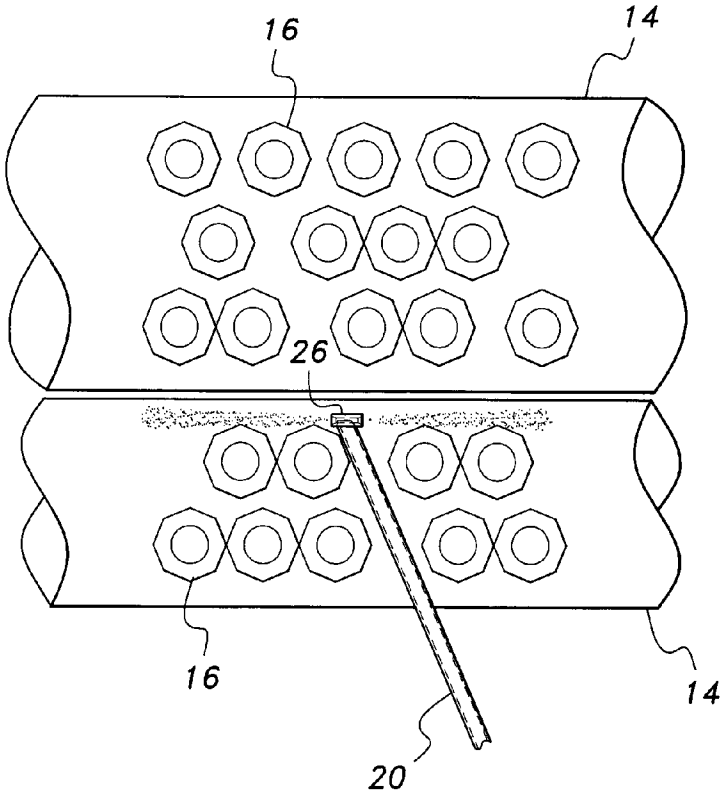
Figure 21:
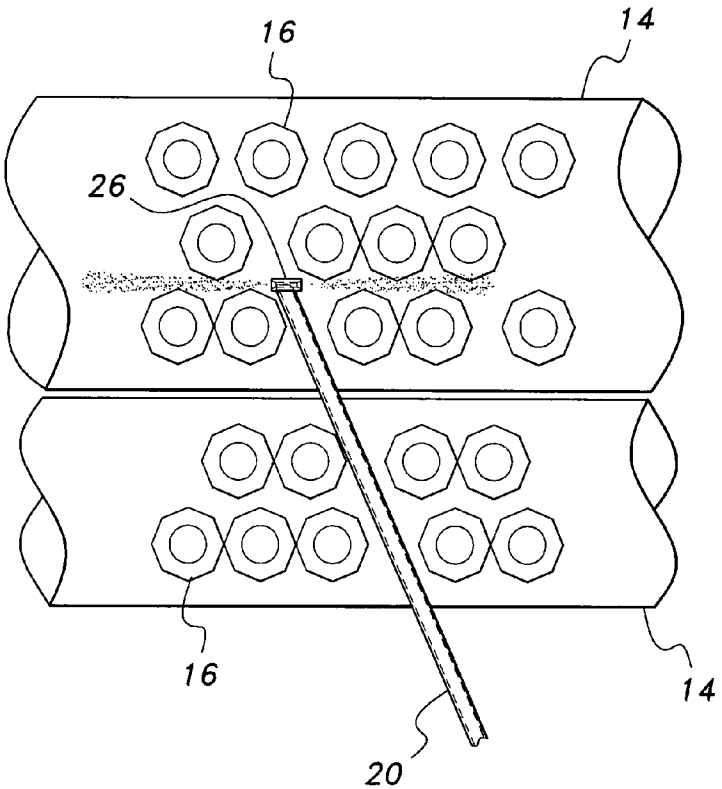
Figure 22:
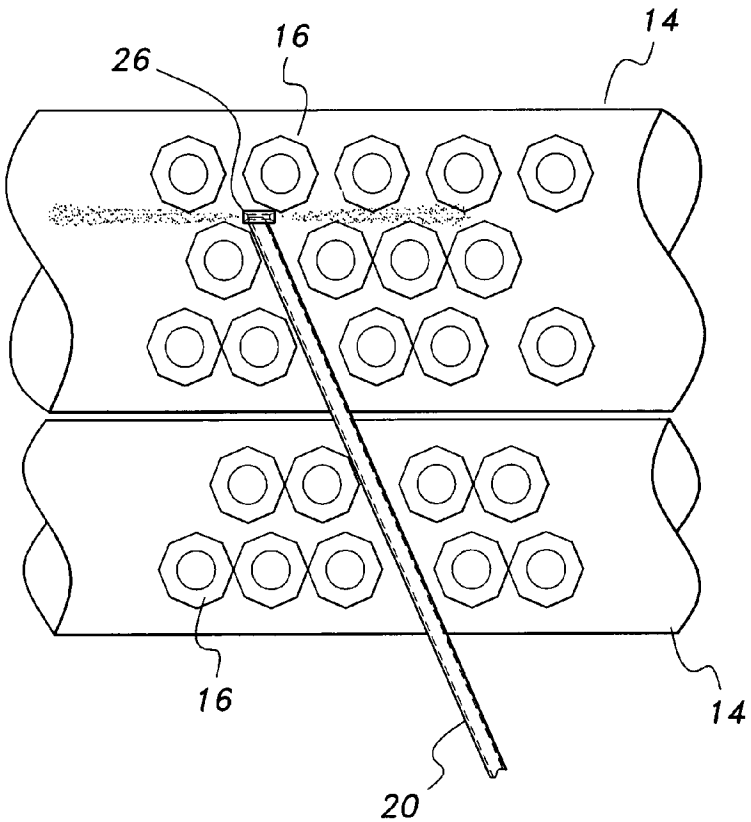

Attention is now directed to FIGS. 12-23, which illustrate the use of the above-described apparatus when cleaning the boiler tubes. The initial cleaning step, shown in FIG. 12, involves cleaning the tube faces on the outer row of the panel. This step requires the use of the nozzle assembly shown in either FIG. 6 or 8. Note that for effective cleaning, the blast cleaning spray from the nozzles 30 (or 32) is applied diagonally to the tubes 16 along diagonal lanes between the tubes. After the faces on the outer row are thoroughly cleaned, wedge 40 is used to spread the first two rows of tubes to form a lane of a desired width, as shown in FIG. 13. A block B (usually made from wood) is inserted in the lane and the pressure on wedge 40 is released. The tubes will clamp the block B in place, as shown in FIG. 14. Another wedge 40 having longer tines is then inserted in the lane to spread a third row of tubes 16, as shown in FIG. 15. A second block B is positioned on the first block and extends into the third row of tubes and is clamped by the tubes in the third row, as shown in FIG. 16, when the wedge is removed. The procedure is repeated for the fourth row of tubes, as shown in FIGS. 17 and 18.

Figure 23:
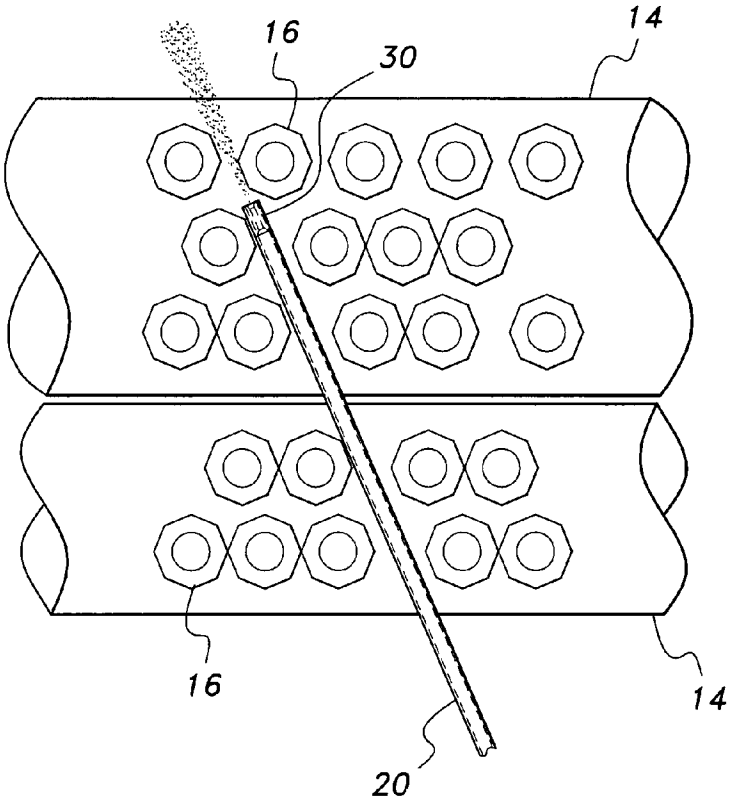

The lane being held open by the blocks B permits access thereto by a selected nozzle assembly. The nozzle assembly shown in either FIG. 2 or 4 is best suited for cleaning tubes in rows 2-4, as shown in FIGS. 19-22. A nozzle assembly as shown in either FIG. 6 or 8 is best suited for cleaning tubes in the fifth or last row, as shown in FIG. 23. It is recommended that the cleaning process be divided among three teams composed of three persons per team.

It is to be understood that the present invention is not limited to the embodiments described above, but encompasses any and all embodiments within the scope of the following claims.

I claim:

1. A method of cleaning the exterior surfaces of water tubes in an HRSG boiler system comprising the steps of:

using a first nozzle assembly to clean tubes on a first row of tubes in a heat exchange panel;

applying a wedge device a first length into tubes to spread the tubes in the first row of tubes in the heat exchange panel thereby forming a first access lane;

inserting a block in the first access lane to maintain the tubes in the spread position and removing the wedge device;

applying a wedge device a second length into tubes to spread tubes in a successive row of tubes in the heat exchange panel thereby forming a second access lane aligned with the first access lane;

inserting a block in the second access lane to maintain the tubes in the spread position and removing the wedge device;

inserting a selected nozzle assembly in the access lanes; and spraying a cleaning fluid via the selected nozzle assembly to clean the exterior surfaces of the tubes wherein the first length is different than the second length.

2. The method of cleaning the exterior surfaces of water tubes in an HRSG boiler system according to claim 1, further comprising the step of:

removing said blocks after cleaning the tubes.

3. The method of cleaning the exterior surfaces of water tubes in an HRSG boiler system according to claim 2, wherein said selected nozzle assembly is a side blow nozzle assembly.

4. The method of cleaning the exterior surfaces of water tubes in an HRSG boiler system according to claim 2, wherein said selected nozzle assembly is an end blow nozzle assembly.

* * * * *